US009919905B2

(12) United States Patent
Nussbaum

(10) Patent No.: US 9,919,905 B2
(45) Date of Patent: Mar. 20, 2018

(54) LIFT APPARATUS FOR LIFTING HEAVY LOADS

(71) Applicant: OTTO NUSSBAUM GmbH & Co. KG, Kehl-Bodersweier (DE)

(72) Inventor: Hans Nussbaum, Kehl-Bodersweier (DE)

(73) Assignee: Otto Nussbaum GmbH & Co. KG, Kehl-Bodersweier (DE)

( * ) Notice: Subject to any disclaimer, the term of this patent is extended or adjusted under 35 U.S.C. 154(b) by 155 days.

(21) Appl. No.: 14/552,975

(22) Filed: Nov. 25, 2014

(65) Prior Publication Data

US 2015/0144853 A1 May 28, 2015

(30) Foreign Application Priority Data

Nov. 27, 2013 (DE) ..... 10 2013 019 722

(51) Int. Cl.
*B66F 3/24* (2006.01)
*B66F 3/46* (2006.01)
*B66F 7/20* (2006.01)

(52) U.S. Cl.
CPC ..... *B66F 3/46* (2013.01); *B66F 3/24* (2013.01); *B66F 7/20* (2013.01)

(58) Field of Classification Search
CPC ..... B66F 3/24; B66F 3/46; B66F 7/20; B66F 7/16; B66F 7/0675
USPC ..... 254/89 H; 100/269.06
See application file for complete search history.

(56) References Cited

U.S. PATENT DOCUMENTS 1,878,738 A * 9/1932 Warner ..... E21D 9/10 254/89 H
4,161,229 A * 7/1979 Mifsud ..... G01V 1/047 181/114
4,230,304 A * 10/1980 Tol ..... F15B 11/22 254/89 H (Continued)

FOREIGN PATENT DOCUMENTS

CN 101746692 6/2010
CN 101746692 A * 6/2010 ..... B66F 7/08

(Continued)

*Primary Examiner* — Joseph J Hail
*Assistant Examiner* — Arman Milanian
(74) *Attorney, Agent, or Firm* — Volpe and Koenig, P.C.

(57) ABSTRACT

A lift apparatus having a plurality of cylinder-piston assemblies arranged in pairs with respectively one hydraulic medium supply and drain. For each pair of assemblies, one cylinder-piston assembly is a command assembly and connected thereto is a hydraulic pressure supply. The respective other cylinder-piston assembly is a response assembly, with its supply connected to the drain of the command assembly. For synchronized lifting at several lift points without active regulation, at least three pairs of assemblies hydraulically cooperate with each other in a serial circuit with the hydraulic medium drain of the command assembly of an upstream pair of assemblies is connected to the hydraulic medium supply of the response assembly of the next downstream pair of assemblies and the hydraulic medium drain of the command assembly of the last pair of assemblies is connected to the hydraulic medium supply of the response assembly of a first assembly pair.

12 Claims, 5 Drawing Sheets

(56) References Cited

U.S. PATENT DOCUMENTS

| | | | | | |
|---|---|---|---|---|---|
| 4,573,663 | A * | 3/1986 | Nussbaum | B66F 7/065 | 254/122 |
| 4,661,749 | A * | 4/1987 | Finkbeiner | B66F 3/46 | 254/89 H |
| 4,949,540 | A * | 8/1990 | Wich | B66F 7/20 | 137/99 |
| 5,553,990 | A | 9/1996 | Kytola, Sr. | | |
| 6,189,432 | B1 * | 2/2001 | Colarelli | B66F 7/20 | 91/171 |
| 6,811,000 | B1 * | 11/2004 | Granata | B66F 7/08 | 187/213 |
| 2003/0192744 | A1 * | 10/2003 | Green | B66F 7/20 | 187/277 |
| 2006/0102432 | A1 * | 5/2006 | Matsumoto | B66F 7/20 | 187/203 |
| 2006/0182563 | A1 * | 8/2006 | De Jong | B66F 3/24 | 414/427 |
| 2012/0067672 | A1 * | 3/2012 | Nussbaum | B66F 7/20 | 187/213 |

FOREIGN PATENT DOCUMENTS

| | | | | |
|---|---|---|---|---|
| DE | 1128962 | B * | 5/1962 | B66F 3/46 |
| DE | 29916254 | U1 * | 3/2000 | B66F 7/0666 |
| DE | 29916254 | U1 | 3/2000 | |
| DE | 20214066 | | 3/2003 | |
| EP | 2428482A1 | A1 | 3/2012 | |
| FR | 2380218 | A1 * | 9/1978 | B66F 7/20 |
| GB | 1022577 | A * | 3/1966 | B66F 3/46 |
| JP | H0826684 | | 1/1996 | |
| JP | H1121088 | | 1/1999 | |
| JP | H1121088 | A * | 1/1999 | B66F 5/04 |
| WO | 2013062215 | | 5/2013 | |

* cited by examiner

LIFT APPARATUS FOR LIFTING HEAVY LOADS

INCORPORATION BY REFERENCE

The following documents are incorporated herein by reference as if fully set forth: German Patent Application No. 10 2013 019 722.8, filed Nov. 27, 2013.

BACKGROUND

The invention relates to a lift apparatus for lifting heavy loads, particularly a lift platform, comprising a plurality of cylinder-piston assemblies, arranged in pairs, comprising one hydraulic medium supply and one hydraulic medium drain each, in which each pair of assemblies comprises a cylinder-piston assembly connected to a pressure connection of at least one hydraulic pump, operating as a master assembly, and the respectively other cylinder-piston assembly is operated as a slave assembly, in which its hydraulic medium supply is connected to the hydraulic medium drain of the cylinder-piston assembly operated as a master assembly.

A generic lifting apparatus in the form of a scissor platform is known from the publication DE 29916254U1. It comprises two scissor frames, which are operated from a pair of assemblies. One cylinder-piston assembly of each pair of assemblies serves as a master assembly and is hydraulically coupled to the second cylinder-piston assembly of the other pair of assemblies, acting as a slave assembly. This is advantageous in that two separate circuits are provided, so that in case of any leak or a break of a hydraulic line the lift platform is prevented from lowering, because the assembly of the second hydraulic circuit, not affected by the defect, takes of the holding function of the defective assembly for both scissor frames.

Different design principles are known for lift platforms. In addition to scissor platforms, primarily columns or piston lift platforms are used. Usually they are operated hydraulically. When a transfer of force occurs during the lifting via more than one point of action, thus over several lift elements, the strokes of the hydraulic drives involved must be synchronized in order to ensure a homogenous and simultaneous lifting process.

In case of two points of action, a command/response and/or master/slave-arrangement can be used. Here, dual-action hydraulic cylinders with a hydraulic medium supply and a hydraulic medium drain are used. A first hydraulic cylinder serves as the master cylinder, with its hydraulic medium drain being connected to the hydraulic medium supply of the second hydraulic cylinder, operating as the response cylinder. Thus, the master cylinder and the response cylinder form a closed hydraulic circuit so that their strokes are mandatorily synchronized.

In the event a lifting process needs to occur simultaneously at more than two hosting points, synchronization of the hydraulic cylinders required for this purpose occurs usually by a respective active control circuit by measuring the strokes or the displaced volume of hydraulic fluid. This is expensive and subject to errors, though.

Additionally, in hydraulic lift platforms it is important for safety reasons that in case of a hydraulic failure a raised vehicle cannot descend unintentionally and in an uncontrolled fashion. Accordingly, frequently additional locking latches, brakes, or other fastening elements are used, which in case of a defect prevent any descending.

SUMMARY

The objective of the invention is to provide a lift apparatus for lifting heavy loads, which allows a synchronous lifting at several points of action without any active control and preferably ensures secure operation without any additional fastening means.

The objective is attained using one or more features of the invention provided below and in the claims.

In one generic lift apparatus at least three pairs of assemblies are provided, which engage different points of action of a vehicle or its support. The pairs of assemblies are no longer coupled to each other by a cross-connection, as common in prior art, but hydraulically in a serial circuit, namely such that the hydraulic medium drain of the command assembly of the upstream pair of assemblies is respectively connected to the hydraulic supply of the downstream assembly of the next following pair of assemblies, with it here being essential that the hydraulic medium drain of the command assembly of the last pair of assemblies is connected to the hydraulic medium supply of the downstream assembly of the first pair of assemblies.

The invention is based on the acknowledgment that a command/response assembly of cylinder-piston assemblies not only allows a synchronous lifting at two lift points or the introduction of a redundant second hydraulic circuit, but that in case of a paired arrangement of cylinder-piston assemblies, by a command/response assembly, a mandatory synchronization of the strokes can be achieved of separately addressed hydraulic assemblies. Such pairs of assemblies, in which respectively one command and one response assembly are mechanically coupled to each other, can be connected to form a serial circuit for an almost arbitrary length, according to the knowledge of the applicant, with respectively the hydraulic medium drain of the command assembly being connected in a fluid-conducting fashion to the hydraulic medium supply of the response assembly of the next downstream pair of assemblies. From the last pair of assemblies in the serial circuit a ring closure occurs back to the first pair of assemblies, by the hydraulic medium drain of the respective command assembly being connected in a fluid-conducting fashion to the hydraulic medium supply of the downstream assembly of the first pair of assemblies. This way, the strokes of all pairs of assemblies coupled to each other in a hydraulic fashion are mandatorily synchronized. Here, it is understood that the term pair of assemblies as a first and/or last pair of assemblies of the serial circuit is arbitrary and occurs without any limitation of the general application.

Such a lift apparatus with three or more pairs of assemblies is primarily suitable for lifting heavy and extremely heavy loads, particularly motor vehicles as well as trucks, locomotives, or the like. By the possibility to serially switch an almost arbitrary number of pairs of assemblies and to synchronize them in the manner according to the invention for example even a tractor-trailer including its trailer attachment or entire freight trains can be lifted simultaneously.

In order to yield an additional mandatory synchronization the cylinder-piston assemblies of each pair of assemblies can be coupled to each other in a simple mechanic fashion. This occurs for example by each cylinder and piston of the two cylinder-piston assemblies of each pair of assemblies being connected to each other in a stiff fashion or via a common component, which they engage.

In order to prevent any descending of the lift apparatus in case of a loss of pressure in one of the hydraulic circuits, in one preferred further development of the invention a non-return valve is provided at least in one hydraulic medium supply of at least one of the command assemblies. Preferably one non-return valve is provided for each hydraulic circuit, most preferably for each master cylinder.

When not only the respective master cylinder assembly but also the corresponding response assembly is embodied with a dual-action hydraulic cylinder, preferably the hydraulic medium drains of the cylinder-piston assemblies operating as response assemblies are connected to a reservoir of at least one hydraulic pump.

In order to compensate deviations in the synchronization of the individual cylinder-piston assemblies, which may occur for example by different thermal expansion, air pockets, or minor leakages at the piston gaskets, an overflow channel may be provided at respectively at least one cylinder-piston assembly of each pair of assemblies, which is arranged such that only in an end position of the respective cylinder-piston assembly the hydraulic medium supply of the respective assembly is connected to the overflow channel in a fluid-conducting fashion. In particular, such an overflow channel is realized in the form of a recess, for example a groove, in the inner wall of the cylinder of the respective cylinder-piston assembly. Alternatively, two bores may also be provided, arranged spaced apart from each other in the direction of displacement of the piston, which are connected to each other in a fluid-conducting fashion.

Such an overflow channel is described in the context with a command/response assembly of two cylinder-piston assemblies in the publication EP2428482A1, which here is incorporated herein by reference as if fully set forth in order to avoid unnecessary repetitions.

The overflow channel may be embodied such that it connects the hydraulic medium supply and the hydraulic medium drain of the assembly to each other in the area of the upper or the lower dead center position of the respective cylinder-piston assembly. This way, when for example the command assembly is set in the end position, the hydraulic fluid can flow from the hydraulic medium supply via the hydraulic medium drain of the command assembly directly to the hydraulic medium supply of the response assembly and activate it, if it perhaps was not yet completely in the end position.

It is also possible to directly connect the overflow channel of the command assembly to the hydraulic medium supply of the response assembly. Preferably both the command assemblies as well as the response assemblies are provided with an overflow channel, with the overflow channel of one command assembly being connected to the hydraulic medium supply of the corresponding response assembly and the overflow channel of the response assembly to the reservoir of at least one hydraulic pump.

In preferred embodiments, the lift apparatus is embodied as a column and/or plunger lift platform, in which respectively one pair of assemblies is provided as a drive for each lifting column and/or plunger.

If the lift apparatus is embodied as a column lift platform, the cylinder-piston assemblies may be arranged suspended in the lifting columns so that any lifting occurs under tension respectively by a piston inserting into a cylinder of the cylinder-piston assemblies. However, if the lift apparatus is embodied as a plunger lift platform, the cylinder-piston assemblies are preferably arranged such that any lifting occurs under pressure, respectively by an extension of a piston out of the cylinder of the cylinder-piston assembly.

In another embodiment the lift assembly can be embodied in the form of a scissor lift platform with two rails, which are respectively supported by at least two, preferably four pairs of assemblies. The cylinder-piston assemblies of one pair of assemblies each form scissor levers, by the ends facing away from one of the rails being connected to each other in an articulate fashion and at the other end being linked to the corresponding rail at points distanced from each other.

In order to prevent the rails tipping laterally and to allow avoidance of an additional guidance, here preferably four pairs of assemblies are provided per rail, with the cylinder-piston assemblies of respectively two pairs of assemblies being arranged laterally offset in reference to each other and connected to each other in an articulate fashion at their end, facing away from the rail, via a common rotary axis.

BRIEF DESCRIPTION OF THE DRAWINGS

In the following additional features, advantages, and characteristics of the present invention are explained based on the figures and based on exemplary embodiments. Shown are.

DETAILED DESCRIPTION OF THE PREFERRED EMBODIMENTS

Figure 1:
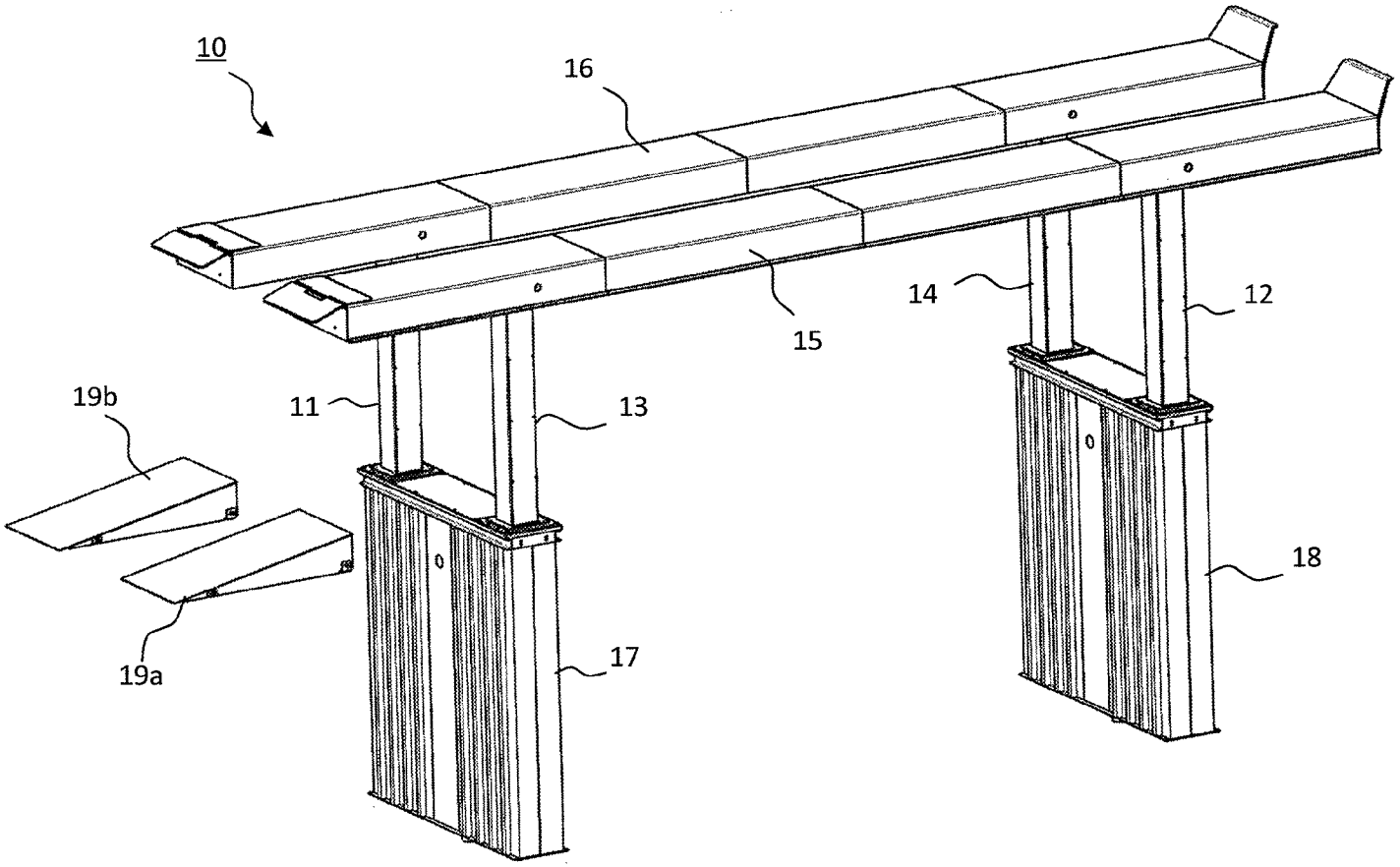
FIG. 1 is an isometric view of a column lift platform with four synchronized, hydraulically operated lift pistons according to the invention.

FIG. 1 shows in a first exemplary embodiment a plunger lift platform 10 with four lift plungers 11-14. Two parallel drive-up rails 15, 16 are supported by the lift plungers 11-14, onto which a motor vehicle can drive and be lifted thereby. Two lift plungers each carry one of the drive-up rails 15, 16.

The lift plungers 11-14 are operated by hydraulic drives, which are provided together with respective plunger drives in assembly boxes 17, 18. These assembly boxes 17, 18 are provided for the underground assembly in the floor of the garage and/or in a respective pit inside the floor of the garage. One hydraulic drive of the lift plungers 11, 12 each is provided at the front end and the hydraulic drives of the lift plungers 13, 14 at the rear end of the two drive-up rails 15, 16 in pairs in a common assembly box 17, 18.

The installation of the assembly boxes occurs such that their respective upper edges end flush with the level of the floor of the garage (not shown). Two ramps 19*a*, 19*b* are mounted at the front end of the drive-up ramps 15, 16 on the garage floor so that in the lowered state of the plunger lift platform 10 a vehicle can drive up via the ramps 19*a*, 19*b* onto the drive-up rails 15, 16.

Cylinder-piston assemblies serve as the hydraulic drives, which are arranged in pairs so that two cylinder-piston assemblies are allocated to each lift plunger 11-14. A pair of assemblies therefore respectively forms a lift element of the lift platform, in which overall eight cylinder-piston assemblies are provided for the four lift-plungers 11-14. The two cylinder-piston assemblies of a pair of assemblies are therefore fastened upright inside or underneath the corresponding lift plunger so that the lift plunger is lifted by a synchronous extension of the pistons of the two cylinder-piston assemblies. As explained in the following with reference to FIG. 3, the individual pairs of assemblies are here combined for a hydraulic serial connection of command/response assemblies.

Figure 2:
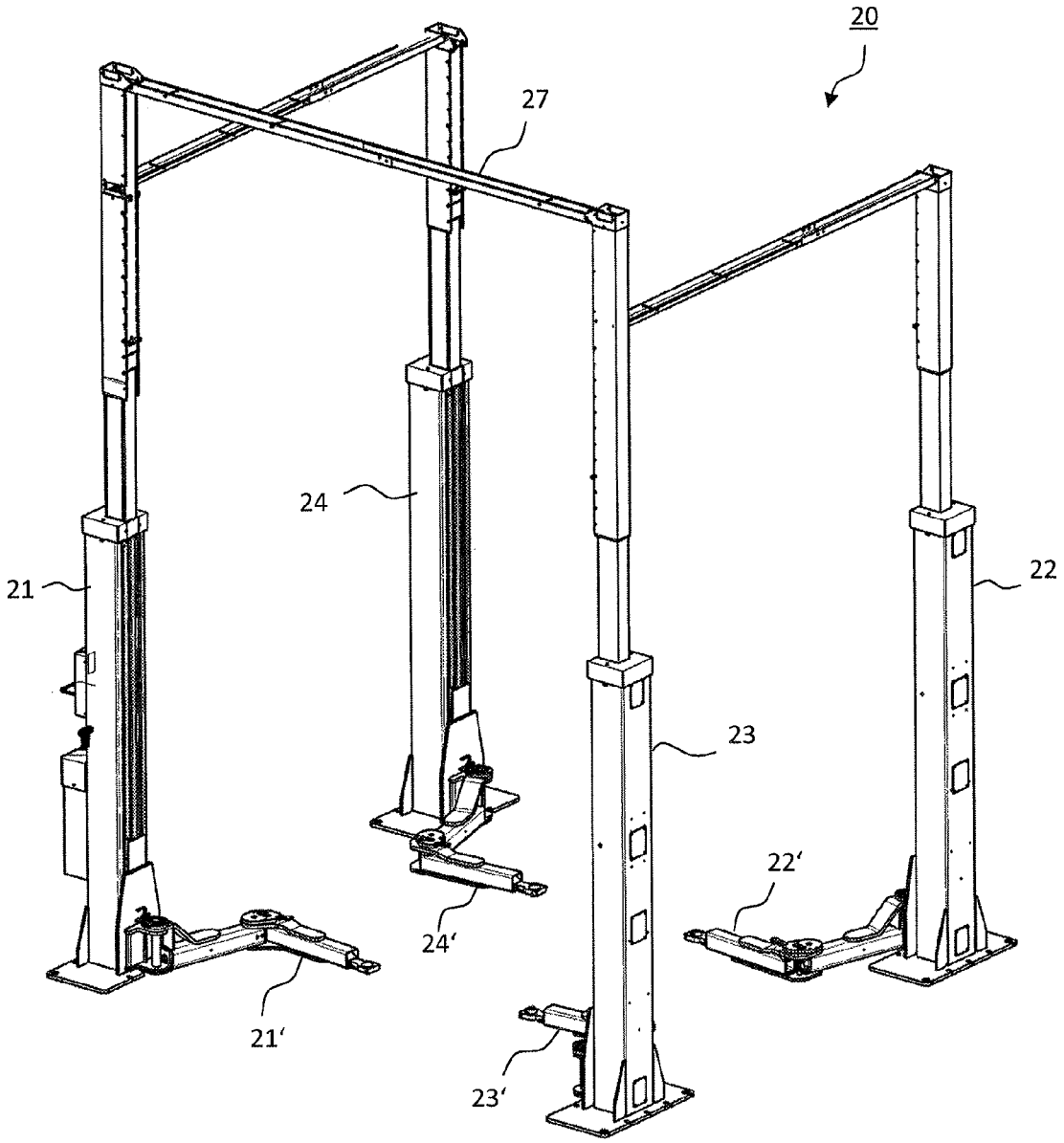
FIG. 2 is an isometric view of a column lift platform with four hydraulically operated lift columns.

As a second exemplary embodiment, FIG. 2 shows a column lift platform. It comprises 4 lift columns 21-24, each of which showing a hydraulically operated cantilever 21'-24'. The cantilevers 21'-24' can be pivoted under the vehicle, which drove between the lift columns, and positioned such that the vehicle can be lifted with the cantilevers 21'-24'.

The lift columns 21-24 are each individually placed and bolted to the garage floor. Each lift column 21-24 comprises a hydraulic drive, which, similar to the first exemplary embodiment, is formed by two cylinder-piston assemblies per lift column. The cylinder-piston assemblies are here assembled suspended in the lift columns such that any lifting under tension occurs by a synchronous insertion of the piston into the cylinder of the cylinder-piston assemblies. Hydraulic lines 25, extending above the lift columns, connect the cylinder-piston assemblies of the individual lift columns in a hydraulic fashion.

Figure 3:
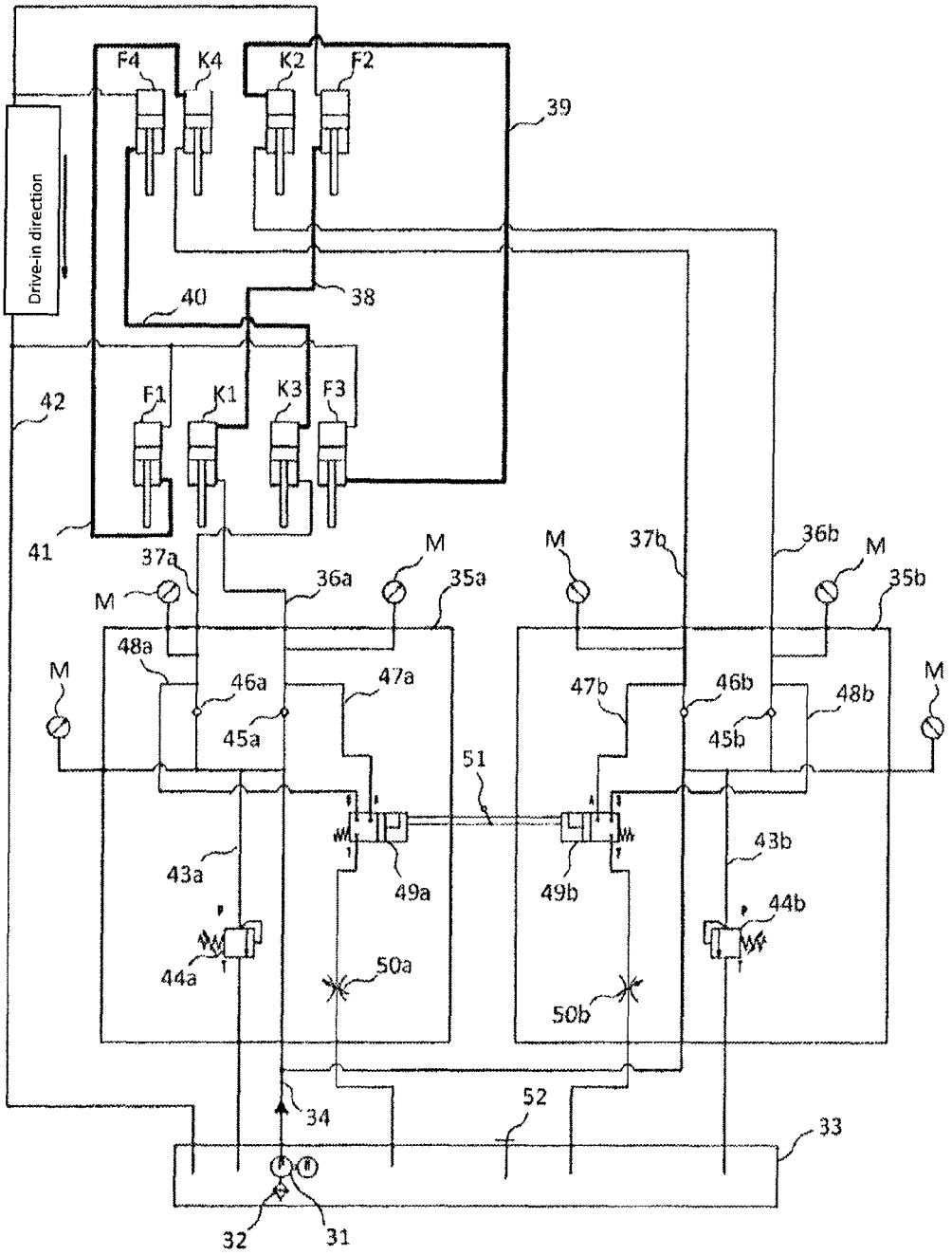
FIG. 3 is a hydraulic plan of a lift apparatus operated with four pairs of assemblies as shown in FIG. 2.
Figure 4:
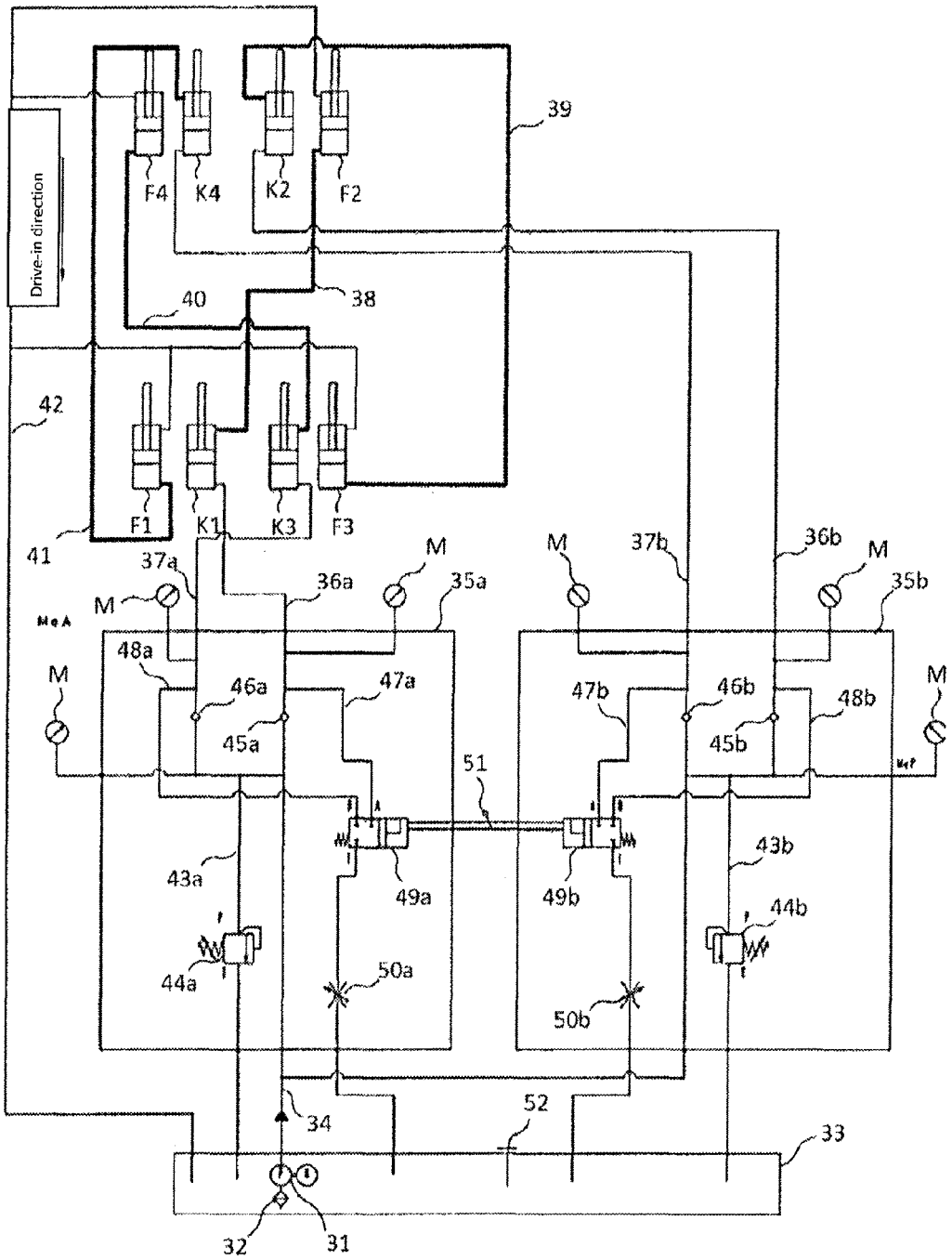
FIG. 4 a hydraulic plan for a lift apparatus with four lift plungers as shown in FIG. 1.

FIG. 3 shows a schematic illustration of a hydraulic plan of the lift platform 20 based on the second exemplary embodiment. The arrangement includes eight cylinder-piston assemblies K1, F1 to K4, F4, which are grouped to four pairs of assemblies. As already mentioned, each pair of assemblies is allocated to one of the lift columns 21-24 of the lift platform 20. In the hydraulic plan shown the cylinder-piston assemblies are connected such that by impinging with pressure a contraction of the pistons occurs into the cylinders and thus a lifting under tension. In the plunger lift platform 10 of FIG. 1 the respective cylinder-piston assemblies are connected inversely, so that by impinging with pressure the pistons extend out of the cylinders and thus a lifting occurs under pressure. A respective hydraulic plan for the plunger lift platform 10 of FIG. 1, in which the cylinder-piston assemblies are installed such that a lifting occurs by the piston rods extending under pressure, is shown in FIG. 4. In FIGS. 3 and 4, identical or similarly acting components are marked with the same reference characters.

Each pair of assemblies F1, K1; F2, K2; F3, K3; and F4, K4 includes respectively one command and one response assembly. The hydraulic medium supply of the command assemblies K1-K4 is connected via respective hydraulic lines 34, 36*a*, 37*a*, 36*b*, 37*b* with a pressure connection of a pump, here a gear pump 31, which conveys hydraulic liquid via a suction filter 32 from the reservoir 33. The response cylinders F1-F4 are each connected with their hydraulic medium supply to the hydraulic medium drain of the respective command assembly of the upstream pair of assemblies, which is explained in greater detail in the following.

A hydraulic line 34, which branches off a T-part, leads from the pump 31 to two hydraulic blocks 35*a*, 35*b*. The hydraulic block 35*a* supplies the master cylinders K1, K3 at one side of the lift platform. The hydraulic block 35*b* accordingly supplies the master cylinders K2, K4 of the other side of the lift platform.

A first hydraulic line 35*a* leads from the hydraulic block 35*a* to the hydraulic medium supply of the master cylinder K1 and a second hydraulic line 37*a* to the hydraulic medium supply of the master cylinder K3. Accordingly, a first hydraulic line 36*b* leads from the hydraulic block 35*b* to the hydraulic medium supply of the master cylinder K2 and a respective second hydraulic line 37 to the hydraulic medium supply of the master cylinder K4.

When pressure is built up by the pump 31 via the hydraulic line 34 and the hydraulic blocks 35*a*, 35*b* and the hydraulic fluid is conveyed to the command assemblies K1 to K4, the respective pistons of the assemblies K1-K4 are pushed upwards. Here, a lifting occurs of a load suspended at the assemblies. Due to the fact that this represents a dual-action hydraulic cylinder, in which the two opposite piston areas are impinged with hydraulic fluid, the hydraulic fluid is displaced above the respective piston and flows via the upper hydraulic connection of the assemblies K1-K4, serving as the hydraulic medium drain, to the respectively response assembly F1-F4. This way, the piston of the respectively response assemblies F1-F4 are also pushed upwards. The hydraulic fluid displaced by the pistons of the response assemblies F1-F4 is conveyed via overflow lines 42 back into the reservoir 33. Alternatively the response assemblies may also be embodied as only single acting hydraulic cylinders so that no hydraulic fluid is provided at the top of the piston which needs to be conveyed back to the reservoir.

The sizing of the command assemblies K1-K4 and the response assemblies F1-F4 is selected such that their pistons rise at the same speed. For this purpose only the effective (annular) piston area of the response assemblies F1-F4 must be selected of respectively identical size as the piston area of the command assemblies K1-K4.

The hydraulic medium drain of the master cylinder K1 of the first pair of assemblies is connected via a hydraulic line 38 to the hydraulic medium supply of the response cylinder F2 of the second pair of assemblies. Accordingly, the hydraulic medium drain of the master cylinder K2 of the second pair of assemblies is connected via a hydraulic line 39 to the hydraulic medium supply of the response cylinder F3 of the third pair of assemblies. The hydraulic medium drain of the master cylinder K3 of the third pair of assemblies is in turn connected via a hydraulic line 40 to the hydraulic medium supply of the response cylinder F4 of the fourth pair of assemblies, and the hydraulic medium drain of the master cylinder K4 of the fourth pair of assemblies is finally connected via the hydraulic line 41 to the hydraulic medium supply of the response cylinder F1 of the first pair of assemblies. The hydraulic medium drains of all response cylinders are connected via a hydraulic line 42 to the reservoir 33. For a better illustration the hydraulic lines 38-41 are emphasized in bold lines.

This way, a closed serial circuit of the pairs of assemblies develops, forming a ring. The response assembly F2 is synchronized via the hydraulic coupling to the command assembly K1. Due to the fact that the response assembly F2 and the allocated command assembly K2 engage the same point of lifting, the stroke and the speed of these assemblies must also be synchronized to each other. Due to the hydraulic coupling between the command assembly K3 and the response assembly F3 the synchronization between the second and the third pair of assemblies is mandatorily achieved, similarly between the third and fourth pair of assemblies by the hydraulic coupling between the command assembly K3 and the response assembly F4, as well as between the fourth and the first pair of assemblies by the hydraulic coupling between the command assembly K4 and the response assembly F1.

In the hydraulic block 35*a*, which in principle is embodied identical to the hydraulic block 36*b*, the pressure line 34, which comes from the pump 31, branches to the two hydraulic lines 36*a*, 37*a*, which lead to the command assemblies K1 and K3, respectively. Another branching leads via the hydraulic line 43*a* and a pressure limiting valve 44*a* back to the reservoir. The pressure limiting valve 44*a* serves as a safety valve in order to compensate pressure peaks and additionally opens the lift platform in case of overload.

Respectively one non-return valve 45*a*, 46*a* is provided for each hydraulic line 36*a*, 37*a*. It has the function to prevent a descending of the lift platform in case of a hydraulic leak in one of the hydraulic circuits, because it prevents any reverse flow of the hydraulic fluid and thus any drop in pressure in the other hydraulic circuits. The hydraulic pressure in the individual hydraulic circuits can be checked upstream and downstream the non-return valves using appropriate manometers M, in order to detect any potential pressure deviations and defects. Additionally, the function of the non-return valves 45*a*, 46*a* can be checked by the manometers M.

One branching off the hydraulic lines 36*a*, 37*a* each is provided downstream the non-return valves 45*a*, 46*a*, which leads via respective hydraulic lines 47*a*, 48*a* to a 3/2-directional valve 49*a*, for example a ball cock integrated in the hydraulic block 35*a*. Via the 3/2-directional valve 49*a*, using a counter-torque brake 50*a*, the hydraulic fluid can be drained from the lines 36*a*, 37*a* and conveyed back into the reservoir 33. The 3/2-directional valve 49*a* and the counter-torque brake 50*a* serve for a controlled lowering of the lift platform.

As already mentioned, the two hydraulic blocks 35*a*, 35*b* are designed identically, in general. The respectively equivalent parts are marked with the reference characters 43*a*-50*a* and/or 43*b*-50*b*. The two 3-2-directional valves 49*a*, 49*b* are mechanically connected to each other via a common operating lever 51 so that it is ensured that both 3/2-directional valves 49*a*, 49*b* are simultaneously opened and closed again in order to lower the lift platform. A measuring rod 52 in the reservoir allows the monitoring of the fill level of the hydraulic fluid.

In general, it would also be possible to install only one non-return valve downstream the branching of the hydraulic line 34 upstream each of the hydraulic blocks 35*a*, 35*b*, instead of the non-return valves 35*a*, 36*a* (or of course additional ones). In case of a hydraulic leak then the pressure in the affected hydraulic block would drop, while the pressure in the other hydraulic blocks was maintained by the locked non-return valve. Due to the fact that the command assemblies K1 and K3 are supplied by one hydraulic block and the command assemblies K2 and K4 by the other one, it would still be ensured that one cylinder-piston assembly of each pair of assemblies, thus either the assemblies K1, F2, K3, F4 or the assemblies K2, F3, K4, F1 would maintain the pressure and this way prevent the lift platform from descending.

The command assembly and the response assembly of each pair of assemblies are both mechanically coupled to each other at the piston side as well as the cylinder side. This way it is ensured that the stroke of one master cylinder is transmitted via the downstream response cylinder, connected thereto in a hydraulic fashion, to the subsequent master cylinder and thus they are synchronized with each other.

Under an appropriate load here a mechanical coupling may perhaps also be waived. Differences in the strokes and/or lifting speeds during the lift would lead to different loads of the assemblies of a pair of assemblies and thus to pressure differences in the respective hydraulic circuits. Due to the fact that the individual hydraulic circuits in the exemplary embodiment are connected to each other in a fluid-conducting fashion like a parallel circuit and are separated only by the non-return valves 46*a*, 47*a*, 46*b*, 47*b* in case of a pressure drop, such pressure differences would be compensated during the subsequent supply of hydraulic fluid so that any disturbances of the synchronization of the pairs of assemblies would be compensated during the lift process.

When pressure differences develop between the hydraulic circuits, this may also represent an indication of a misadjustment of individual cylinder-piston assemblies. In order to allow a simple adjustment of the lift platform as well as a simple bleeding of the hydraulic circuits, the cylinder-piston assemblies comprise overflow channels of the type explained at the outset, which in the end position of the piston connect the hydraulic medium supplies and drains of one assembly each via a small channel in the interior cylinder wall to each other in the area of the end position.

When the lift platform is moved into its end position, via these overflow channels minor stroke differences between individual cylinder-piston assemblies can be compensated, particularly between the respectively hydraulically coupled command and response assemblies. When for example a command assembly reaches the end position first, the hydraulic fluid can directly flow from the hydraulic medium supply via a corresponding overflow channel and via its hydraulic medium drain to the response assembly connected thereto. Consequently, the response assembly then also reaches its end position. Inversely, when the response assembly reaches its end position first, the hydraulic fluid can flow from the hydraulic medium drain of the upstream command assembly via the overflow channel of the following assembly back into the reservoir 33 so that the command assembly can also reach its end position.

In the exemplary embodiment, all command assemblies are supplied by a single hydraulic pump. It would also be possible to provide several hydraulic pumps for the command assemblies, for example one pump per command assembly, or one pump per hydraulic block. However, here it must be observed that no excessive pressure differences develop. This may be achieved, for example, by pressure valves sized appropriately.

Figure 5:
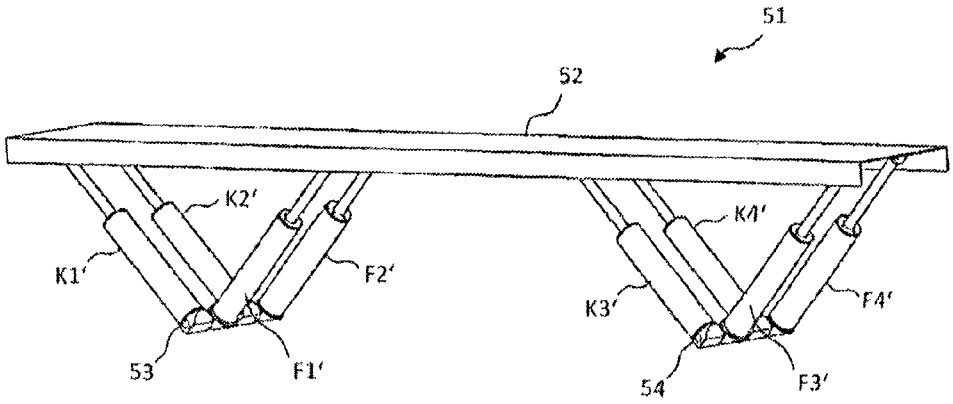
FIG. 5 an isometric view of a lift apparatus in a third exemplary embodiment.

Another exemplary embodiment for a lift apparatus according to the invention is now explained based on FIG. 5. Here, a single lift rail 51 is shown, with typically two such lift rails 51 being combined to form a lift platform. The lift rail 51 comprises a drive-up rails 52, with the eight cylinder-piston assemblies K1'-K4', F1'-F4' being arranged underneath it.

Similar to the previous exemplary embodiments the cylinder-piston assemblies K1'-K4' and F1'-F4' are grouped to pairs of assemblies K1' F1', K2' F2', K3' F3', and K4' F4', with in each pair of assemblies one cylinder-piston assembly being addressed as the command assembly and the other one as the response assembly. Unlike in the previous exemplary embodiments, the cylinder-piston assemblies of a pair of assemblies are here not arranged parallel in reference to each other but they are connected to each other in an articulate fashion at their ends facing the cylinders via respectively an axle 53, 54 at the floor side.

At the top end, facing the piston, the individual cylinder-piston assemblies of each pair of assemblies are linked to the drive-up rail at fastening points distanced from each other. Each pair of assemblies K1' F1', K2' F2', K3' F3', and K4' F4' therefore forms a V-shaped assembly, with its central angle changing with the extended length of the respective cylinder-piston assemblies: When the piston rods insert into the cylinders of the respective assemblies, the central angle becomes more obtuse, until it reaches almost 180°, and the drive-up rail 52 rests almost flat on the floor. When the piston rods are extended out of the cylinders the central angle becomes more acute and the drive-up rail 52 is lifted.

This way, the cylinder-piston assemblies of the individual pairs of assemblies can move like scissors closer and/or farther apart in order to hoist the drive-up rails 52 and thus act like scissor levers of a scissor platform of prior art.

In principle, it would be sufficient to provide respectively one V-shaped connected pair of assemblies at both ends of the drive-up rail 52. However, the rails then had to be held via an appropriate guidance and this way protected from lateral tipping. Accordingly, in the exemplary embodiment two pairs of assemblies are provided, arranged laterally offset, which prevent any tipping of the drive-up rail. The four cylinder piston assemblies at the two ends of the drive-up rail 52 are here respectively connected to each other via a common rotary axle 53, 54 at the floor side, i.e. the cylinders of the cylinder-piston assemblies K1', F1', K2' and F2' are connected via the floor-side rotary axle 53 and the cylinders of the cylinder-piston assemblies K3', F3', K4', and F4' via the floor-side rotary axle 54.

Due to the fact that the piston rods of the individual cylinder-piston assemblies K1'-K4' and F1'-F4' are each connected at fixed pivot points to the drive-up rail 52, the rotary axis 53, 54, by which the lift rail 51 rests on the floor, moves apart during the lifting of the drive-up rail 52 so that the rotary axle 53, 54 must be guided on the floor in a sliding fashion.

In order to ensure a homogenous and parallel lifting and descending of the drive-up rail 52 the cylinder-piston assemblies K1'-K4' and F1'-F4' must be synchronized. This occurs preferably in the manner according to the invention by a serial switching of the individual pairs of assemblies, i.e. by respectively the hydraulic medium drain of the command assemblies of an upstream pair of assemblies is connected hydraulically to the hydraulic medium supply of the downstream assembly of the next pair of assemblies.

Of course, independent from the presently claimed serial and/or ring circuit of the pairs of assemblies, a lift rail with cylinder-piston assemblies acting as a scissor platform may also be used and thus form an independent technical contribution. Here, it is not necessarily relevant that the pairs of assemblies are operated in a master/salve control and/or as command and response assemblies. Rather, all cylinder-piston assemblies may also be hydraulically addressed independent from each other, as long as this occurs in a sufficiently synchronized fashion.

Figure 6:
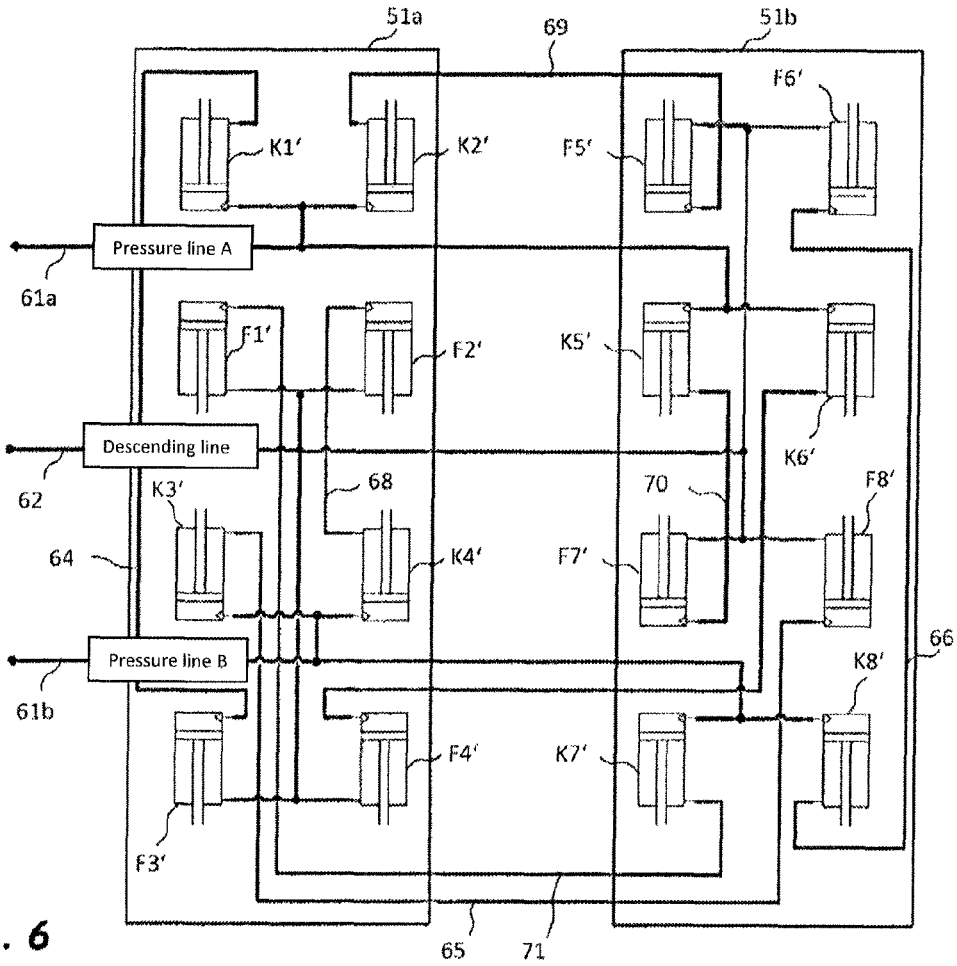
FIG. 6 a hydraulic plan for two lift rails in the design shown in FIG. 5.

As mentioned at the outset, two lift rails 51 may be combined to form a lift platform. Here, too, a simultaneous and homogenous lifting of the two drive-up rails 52 is decisive, so that once more a synchronization by way of serial switching and/or ring switching of the individual pairs of assemblies can be used according to the invention. A respective hydraulic plan for a lift platform with two lift rails 51 is shown in FIG. 6. For this purpose, the first eight cylinder-piston assemblies K1'-K4' and F1'-F4' o the first lift rail 51*a* are shown at the left in the figure and the second eight cylinder-piston assemblies K5'-K8' and F5'-F8' of the second lift rail 51*b* at the right side of the figure.

As provided in the hydraulic plans of FIGS. 3 and 4, two separate pressure lines 61*a*, 61*b* are provided here too, which address the command assemblies, with the corresponding hydraulic blocks not being shown in FIG. 6. The command assemblies K1', K2' of the first lift rail 51*a* as well as the command assemblies K5' and K6' of the second lift rail 51*b* are addressed via the pressure line 61*a*. Accordingly, the command assemblies K3', K4' of the first lift rail 51*a* as well as the command assemblies K7' and K8' of the second lift rail 51*b* are addressed via the second pressure line 61*b*. This way it is ensured that in case of a pressure drop in one of the hydraulic lines 61*a*, 61*b* the lift platform is still held by the assemblies connected to the other pressure lines and thus cannot descend.

The hydraulic medium drains of the response assemblies F1'-F8' are connected via a drainage line 62 to a hydraulic medium reservoir (not shown).

The ring circuit according to the invention results from the fact that

- the master cylinder K1' of the first pair of assemblies is connected via the hydraulic line 64 to the response cylinder F3' of the third pair of assemblies,
- the master cylinder K3' of the third pair of assemblies is connected via the hydraulic line 65 to the response cylinder F8' of the eighth pairs of assemblies,
- the master cylinder K8' of the eighth pairs of assemblies is connected via the hydraulic line 66 to the response cylinder F6' of the sixth pair of assemblies,
- the master cylinder K6' of the sixth pair of assemblies is connected via the hydraulic line 67 to the response cylinder F4' of the fourth pair of assemblies,
- the master cylinder K4' of the fourth pair of assemblies is connected via the hydraulic line 68 to the response cylinder F2' of the second pair of assemblies,
- the master cylinder K2' of the second pair of assemblies is connected via the hydraulic line 69 to the response cylinder F5' of the fifth pair of assemblies,
- the master cylinder K5' of the fifth pair of assemblies is connected via the hydraulic line 70 to the response cylinder F7' of the seventh pair of assemblies, and
- the master cylinder K7' of the seventh pair of assemblies is finally connected via the hydraulic line 71 again to the response cylinder F1' of the first pair of assemblies.

Similar to the above-stated exemplary embodiments, the cylinder-piston assemblies K1'-K8' and F1'-F8' are here once more equipped with overflow channels in the proximity of the upper dead center so that minor travel differences and pressure differences between the individual cylinder-piston assemblies, caused by minor leaks or thermal expansion, can be compensated by a lifting of the lift platform up to its end position.

The invention claimed is:

1. A lift apparatus (10, 20) for lifting heavy loads, comprising a plurality of cylinder-piston assemblies (F1-F4, K1-K4) arranged in pairs, with each of the cylinder-piston assemblies (F1-F4, K1-K4) comprising at least one hydraulic medium supply and at least one part of the cylinder-piston assemblies (K1-K4) additionally including a hydraulic medium drain, and with each of the pairs of cylinder-piston assemblies comprising one of the cylinder-piston assemblies (K1-K4) as a master cylinder-piston assembly, operated as a command assembly connected with a pressure connection of at least one hydraulic pump (31), and the respectively other of the cylinder-piston assemblies (F1-F4) being operated as a response assembly, with a hydraulic medium supply thereto being connected to the hydraulic medium drain of the one of the cylinder-piston assemblies (K1-K4) operated as the command assembly, wherein at least three pairs of the cylinder-piston assemblies are provided and the pairs of cylinder-piston assemblies hydraulically cooperate with each other in a serial circuit, the hydraulic medium drain of the master cylinder-piston assembly (K1, K2, K3) of a first, upstream pair of the cylinder-piston assemblies is connected to the hydraulic medium supply of the response assembly (F2, F3, F4) of the next downstream pair of the cylinder-piston assemblies, and the hydraulic medium drain of the master cylinder-piston assembly (K4) of the last pair of the cylinder-piston assemblies is connected to the hydraulic medium supply of the response assembly (F1) of the first pair of the cylinder-piston assemblies, and the pairs of the cylinder-piston assemblies are fed by first and second pressure lines (36*a*, 36*b*; 37*a*, 37*b*; 61*a*, 61*b*) which are hydraulically separated from each other by first and second non-return valves, each located in a respective ones of the first and second pressure lines in a position upstream from a drain line or by connection to separate hydraulic medium pumps, the first and second pressure lines effecting hydraulic actuation of different ones of the master cylinder-piston assemblies (K1-K4; K1'-K8'), with at least one of the first and second pressure lines effecting hydraulic actuation of at least two of the master cylinder-piston assemblies.

2. The lift apparatus according to claim 1, wherein the cylinder-piston assemblies (K1-K4, F1-F4) of each of the pairs of the assemblies are mechanically coupled to each other.

3. The lift apparatus according to claim 1, wherein respectively at least one of the cylinder-piston assemblies (K1-K4, F1-F4) of each of the pairs of assemblies comprises an overflow channel, which is arranged such that the hydraulic medium supply of the respective cylinder-piston assembly is connected to the overflow channel in a fluid-conducting fashion only in an end position of the respective cylinder-piston assembly.

4. The lift apparatus according to claim 1, wherein the hydraulic medium drains of the cylinder-piston assemblies (F1-F4), operated as response assemblies, are connected to a reservoir (33) of the at least one hydraulic pump (31).

5. The lift apparatus according to claim 1, wherein the pairs of cylinder-piston assemblies engage different stroke points of at least one lift platform (15, 16).

6. The lift apparatus according to claim 1, wherein the lift apparatus is embodied as a column or plunger lift platform (20, 10) in which one of the pairs of cylinder-piston assemblies is provided for each stroke column (21-24) or each plunger (11-14).

7. The lift apparatus according to claim 6, wherein the lift apparatus is embodied as the column lift platform (20) and the cylinder-piston assemblies (K1-K4, F1-F4) are arranged suspended in the stroke columns (21-24) such that a lifting occurs under tension, respectively by inserting a piston into a cylinder.

8. The lift apparatus according to claim 6, wherein the lift apparatus is embodied as the plunger lift platform (10), and the cylinder-piston assemblies (K1-K4, F1-F4) are arranged such that any lifting occurs under pressure, respectively by projecting a piston out of a cylinder.

9. The lift apparatus according to claim 1, further comprising two rails (52), which are supported respectively by at least two pairs of the cylinder-piston assemblies (K1' F1', K2' F2', K3' F3', K4' F4', K5' F5', K6' F6', K7' F7', K8' F8'), with the cylinder-piston assemblies of each of the pair of assemblies being connected as scissor levers at one end facing away from the rail (52) in an articulate fashion and at the other end linked at points at the respective rail (52) spaced apart from each other.

10. The lift apparatus according to claim 9, wherein four of the pairs of the cylinder-piston assemblies are provided per each of the rails (52) and in which the cylinder-piston assemblies of respectively two of the pairs of the cylinder-piston assemblies are arranged laterally offset in reference to each other and are connected to each other in an articulate fashion at ends thereof facing away from the rail (52) via a common rotary axle (53, 54).

11. The lift apparatus according to claim 1, further comprising first and second 3/2-directional valves (49*a*, 49*b*) that branch off of the first and second pressure lines respectively, to allow hydraulic fluid to be drained from the pressure lines and conveyed back into a reservoir (33) of the at least one hydraulic pump (31) for a controlled lowering of the lift platform.

12. The lift apparatus according to claim 11, further comprising a common operating lever (51) connecting the first and second 3/2-directional valves (49*a*, 49*b*) to each other for simultaneous opening and closing of the first and second 3/2-directional valves.

* * * * *